United States Patent [19]

Tassie

[11] 4,050,352

[45] Sept. 27, 1977

[54] RENEWABLE LIQUID INVESTMENT SEAL

[75] Inventor: Douglas Pray Tassie, St. George, Vt.

[73] Assignee: General Electric Company, Burlington, Vt.

[21] Appl. No.: 668,546

[22] Filed: Mar. 19, 1976

[51] Int. Cl.[2] ..... F41F 1/04

[52] U.S. Cl. ..... 89/7; 89/26

[58] Field of Search ..... 89/7, 26; 102/92–94

[56] References Cited

U.S. PATENT DOCUMENTS

| | | | |
|---|---|---|---|
| 407,890 | 7/1889 | Day | 102/92 |
| 440,672 | 11/1890 | Wesson | 102/92 |
| 539,733 | 5/1895 | Gerdom | 89/26 |
| 1,031,320 | 7/1912 | Brown | 102/92 |
| 1,036,171 | 8/1912 | Ackerman | 102/92 |
| 2,942,525 | 6/1960 | Gillman | 89/26 |
| 3,356,029 | 12/1967 | Seidel | 102/92 |
| 3,763,739 | 10/1973 | Tassie | 89/7 |

*Primary Examiner*—David H. Brown
*Attorney, Agent, or Firm*—Bailin L. Kuch

[57] ABSTRACT

A liquid investment seal is provided for the firing chamber of a gun, which seal is renewed at the commencement of each firing.

15 Claims, 9 Drawing Figures

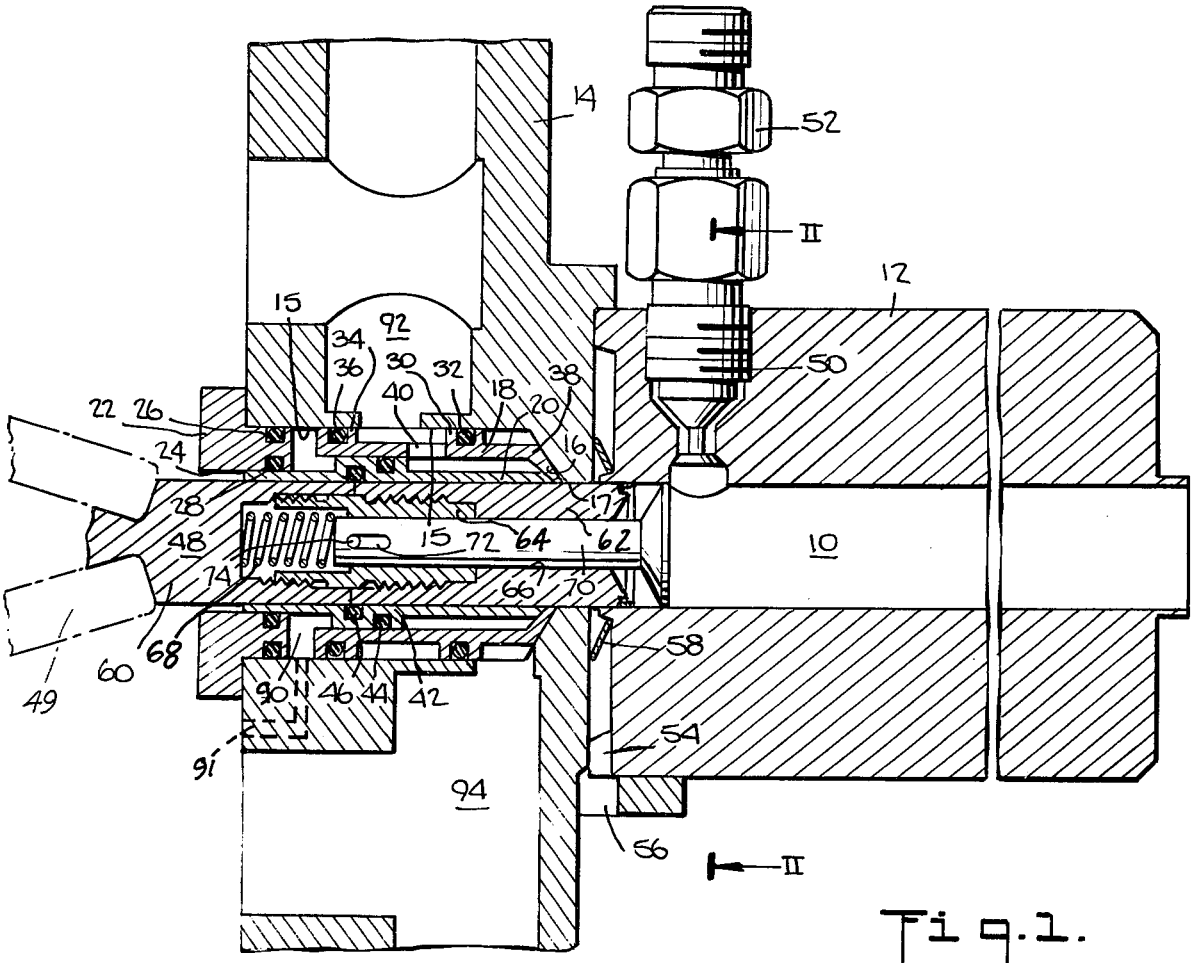
Fig. 1.
Fig. 2.
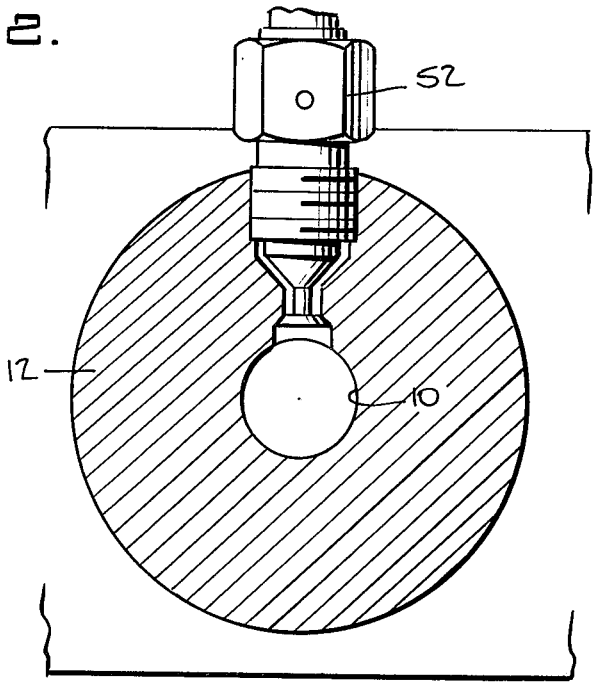

INVESTMENT MATERIAL - DECALIN

INVESTMENT MATERIAL - GREASE

RENEWABLE LIQUID INVESTMENT SEAL

BACKGROUND OF THE INVENTION

1. Field of the Invention

This invention relates to a liquid seal for combustion apparatus, especially adapted for use in liquid propellant, or caseless, or revolver type guns.

2. Prior Art

Annular seals are well known, and are shown, for example, in Hasek, U.S. Pat. No. 2,117,885; Asbury, U.S. Pat. No. 1,376,130; Gerdom, U.S. Pat. No. 539,733; Thierry, U.S. Pat. No. 3,006,254; Wankel, Germany DAS 1,096,697; and Ashley, U.S. Pat. No. 3,783,737. Each of these seals functions by stressing a ring into abutment with a bore to provide a close surface continuum, and is more or less effective for a limited number of firings.

SUMMARY OF THE INVENTION

Liquid propellant guns, other guns firing caseless ammunition, and revolver type guns must be provided with seals to prevent the escape of gas from the firing chamber during a repeated number of firings.

An object of this invention is to provide a seal for such guns which is effective during a repeated number of firings.

A feature of the invention is the provision of a liquid investment seal for the firing chamber of a gun which is renewed at the commencement of each firing.

BRIEF DESCRIPTION OF THE DRAWING

FIG. 1 is a longitudinal cross-section of a firing chamber for a liquid propellant gun, of the type shown, for example, by Tassie in U.S. Pat. No. 3,763,739, issued Oct. 9, 1973, showing a bolt incorporating this invention in its closed and locked disposition;

FIG. 2 is a transverse cross-section of the chamber of FIG. 1, taken along the plane II—II;

DESCRIPTION OF THE FIRST EMBODIMENT OF THE INVENTION

Figure 4:
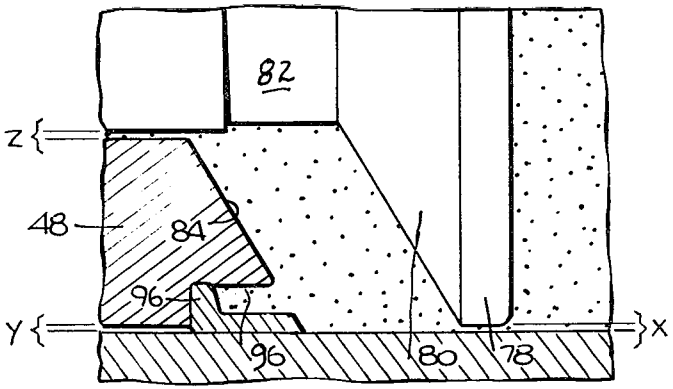
FIG. 4 is an enlarged detail view, in longitudinal cross-section, of the bolt and the chamber of FIG. 1, showing the generation of the liquid investment seal.

In guns firing conventional cased ammunition, the interface between the combustion or firing chamber and the gun bolt is sealed by the cartridge case. A new case is provided for each firing. In many prior art guns utilizing liquid propellant to fire a projectile without a cartridge case, the interface between the chamber and the bolt is closed by a seal ring which is carried by the bolt. In most such guns, the seal ring is stressed by the combustion gas. There is a small initial leakage which causes heating and erosion of the seal ring, and often allows foreign particles to enter the gap and to interfere with the seating of the seal ring. In U.S. Pat. No. 3,783,737, which uses a pre-stressed ring seal, this problem is obviated; however, the metal-to-metal contact does eventually result in frictional wear, galling and fatigue.

To overcome all of these disadvantages this invention provides a liquid which is used to fill or to invest the joint or gap between the bolt and the combustion chamber at a pressure which is higher than the pressure of the combustion gas in the chamber, so that the investment liquid will flow into the chamber, rather than the combustion gas flowing into the joint. Flow control rings may be used to limit the rate of flow of the investment liquid to minimize the loss of the investment liquid.

FIG. 1 shows a combustion chamber 10 in a gun barrel 12 which is fixed to a barrel extension 14, having a longitudinal bore or antechamber 15 having a conical transition portion 16 and a reduced diameter portion 17. Two concentric sleeves 18 and 20 are disposed in the bore 15 which is capped by an L-ring 22 which is fixed to the extension 14 and extends within the bore 15. The L-ring 22 has a longitudinal bore 24, and an outer ring seal 26 and an inner ring seal 28. The outer sleeve 18 has a forward annular rib 30 with an outer ring seal 32 and an aft annular rib 34 with an outer ring seal 36, a forwardmost, inwardly projecting nose cone section 38, and a plurality of radially extending bores 40 located between the ribs. The inner sleeve 20 has an intermediate annular rib 42 having an outer ring seal 44 and an inner ring seal 46, and its aft end extends within the bore 24 against the ring seal 28.

The gun bolt 48, which may be locked to the barrel extension by conventional means, such as wing locks 49, is disposed within the bore 24, and within the inner sleeve 20, against the ring seal 46, and is reciprocatable into the aft portion of the combustion chamber 10. A transverse bore 50 extends through the gun barrel 12 into the aft portion of the combustion chamber, and a spark plug 52 is fixed therein.

An annular recess 54 may be provided in the interface between the gun barrel 12 and the extension 14 about the cahmber 10 with a drain passageway 56 and an annular relief valve 58.

The gun bolt 48 comprises a bolt aft body 60, a bolt forward body 62, and a tubular coupler 64 which fixes together the bodies 60 and 62. The composite body has a blind longitudinal bore 66 in which are disposed a helical compression spring 68 and a piston 70. The aft portion of the piston has a longitudinally extended, diametrical slot 72 in which is disposed a cross-pin 74 whose ends extend into a diametrical bore in the bolt body. The cross-pin thus captures the piston within the bore 66 while permitting limited reciprocation therein. The piston captures the spring 68 within the bore, while the spring biases the piston forwardly. The piston has a head which at its forwardmost end is disk-shaped as at 78 with a conical transition portion 80 leading to the stem 82. The forward portion of the bore 66 is enlarged in a cone-shape, as at 84, to mate with conical portion 80 of the piston head.

Figure 3:
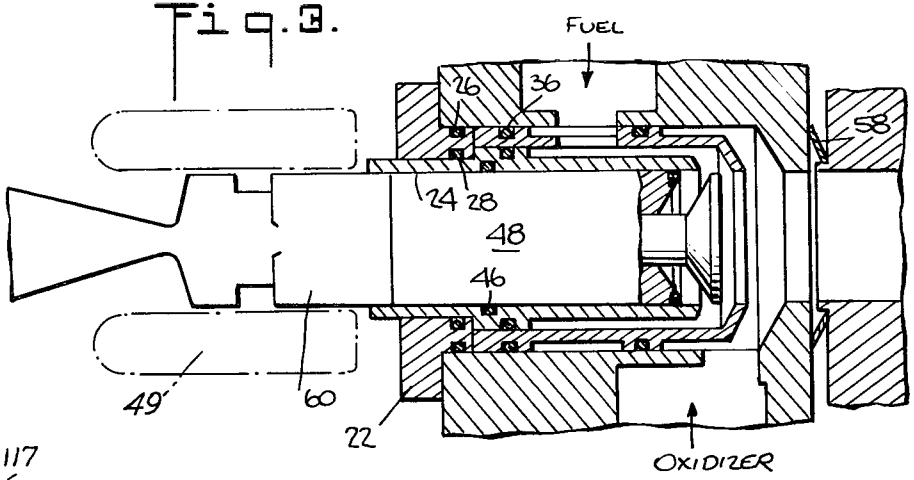
FIG. 3 is a detail view, in longitudinal cross-section, of the chamber of FIG. 1, showing the bolt in its unlocked and propellant filling disposition.

The longitudinal length of the sleeve 18, from its forwardmost portion 38 to its aftmost portion 34 is shorter than the longitudinal length of the bore 15 from its forwardmost conical surface 16 to its aftmost transverse surface provided by the ring 22. Thus the sleeve 18 is free to slide to and between a forwardmost position shown in FIG. 1 and an aftmost position shown in FIG. 3. Similarly, the longitudinal length of the sleeve 20 between it forwardmost end and the annular rib 42 is shorter than the open length of the bore 15. When both sleeves are in their forwardmost positions a void 90 is defined in which is received a quantity of gas under pressure, supplied from a source, not shown, via a conduit 91 assembly. This gas serves as a gas spring, biasing the sleeves towards their forwardmost positions.

The barrel extension 14 also has a radial bore 92 which opens into the bore 15 between the ribs 30 and 34 of the sleeve 18 when the sleeve 18 is in either its fore or aft position. The extension also has a radial bore 94 which opens into the bore 15 forward of the annular rib 30 when the sleeve 18 is in either its fore or aft position. In a liquid propellant gun of the type taught in U.S. Pat. No. 3,763,739, a measured quantity of liquid fuel is pumped through the bore 92 while a measured quantity of liquid oxidizer is pumped through the bore 94. These liquids force the sleeves aft, against the bias of the gas spring, so that fuel passes through the radial bores 40 in the sleeve 18, then forwardly between the sleeves, then around the head of the piston and into the combustion chamber; while oxidizer passes around the conical portion of the sleeve 18 into the combustion chamber. When the supply of fuel and oxidizer under pressure ceases, the gas spring biases the sleeves forwardly, as shown in FIG. 1, to provide a seal between the sleeves 20 and 18 and the barrel extension, forward of the supply bores 92 and 94. The annular flows of fuel and oxidizer guided by the sleeves 18 and 30 intermix to fill the combustion chamber with a relatively homogeneous mixture. A quantity of this liquid mixture is trapped in the annular void between the aft conical surface of the head of the piston and the mating conical surface of the bolt body. As shown in FIG. 4, a leakage interface Z exists between the bolt body and the piston stem, a leakage interface Y exists between the bolt body and the barrel, and a leakage interface X exists between the piston head and the barrel. To permit a more generous clearance between the bolt body and the chamber wall of the barrel, an L-ring seal 96 may be disposed in an annular notch 98 cut into the forward-outer corner of the bolt body. This ring differs from a conventional seal in that no preload against the chamber wall is necessary.

When ignition is provided by the spark plug, the mixture of fuel and oxidizer forward of the piston head adjacent the spark plug burns and generates combustion gas under relatively high pressure. This gas pressure is communicated to the piston head, biasing it aft against the return spring. The liquid trapped or invested behind the piston head is under a relatively higher pressure than the combustion gas, which is equal to the piston head transverse area divided by the difference of the piston head transverse area and the piston stem cross-sectional area, all multiplied by the combustion gas pressure. The invested liquid flows out of the interfaces X, Y, and Z at this relatively high pressure. This forward flow at X, being at a higher pressure than the liquid or gas pressure in the chamber forward of the piston head, precludes any flow aftward of combustion gas at X. The use of the L-ring seal 96 effectively precludes any significant flow of investment liquid at Y, which would otherwise ultimately pass to the atmosphere.

DESCRIPTION OF THE SECOND EMBODIMENT OF THE INVENTION

Figure 5:
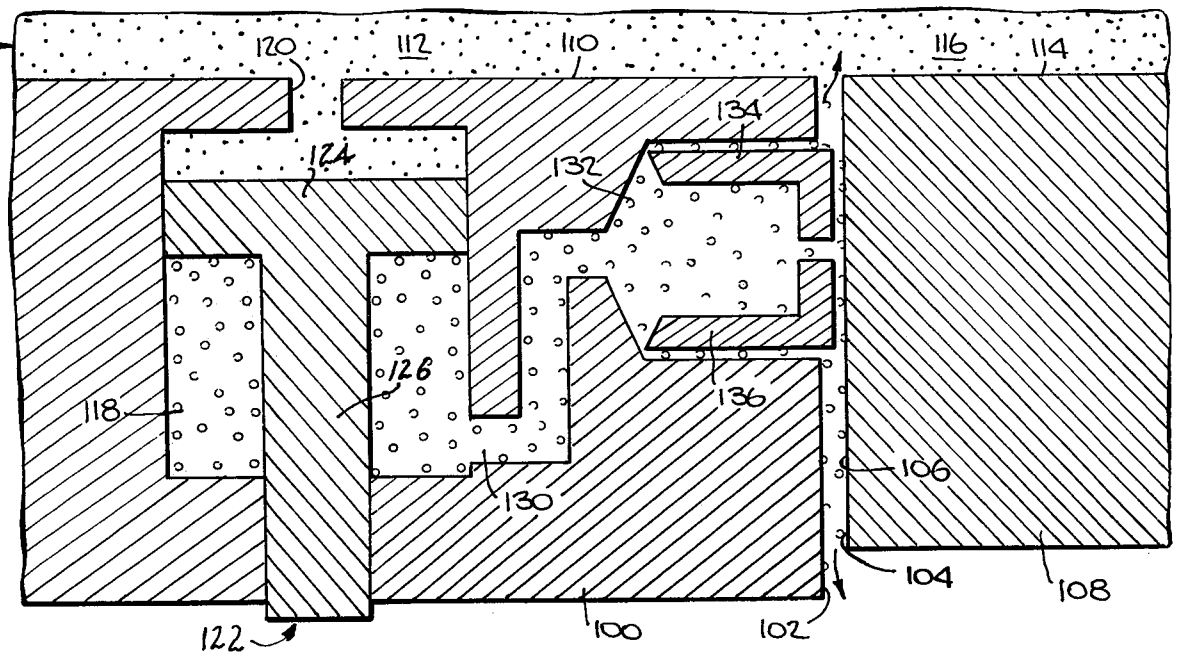
FIG. 5 is a schematic of a portion of a revolver having a firing chamber and a portion of a gun barrel, incorporating this invention.

The invention may also be utilized to seal a revolver to a gun barrel. An exemplary revolver gun is shown in the Final Report, 19 Nov. 1953-31 Jan. 1956, under contract DA-36-034-ORD-1504RD, Project TS1-47-8, page 31, FIG. 16. As is schematically shown in FIG. 5, a revolver 100 has a transverse forward face 102 which is spaced by a leakage interface 104 from a transverse aft face 106 of a gun barrel 108. The inner wall 110 of a chamber 112 of the revolver is aligned with the inner wall 114 of the bore 116 of the gun barrel. Conventional means 117 provide combustion gas to the chamber 112, or the system shown in FIG. 1 may be utilized. A cylinder 118 is provided in the wall of the revolver and has a combustion gas inlet port 120. A piston 122 having a head 124 and a stem 126 is disposed in the cylinder. The cylinder also has an outlet port 130 which communicates with an annular recess 132 cut into the surface 102 and coaxial with the chamber 112. A pair of flow control L-shaped rings 134 and 136 may be disposed in the recess. The cylinder below the piston head is filled with a suitable investment liquid such as grease which can be pumped by the piston head through the recess and into the leakage interface 104. As before, the investment liquid will be pumped into the leakage interface at a pressure which is higher than the pressure of the combustion gas, and which is equal to the piston head transverse area divided by the difference of the piston head transverse area and the piston stem cross-sectional area, all multiplied by the combustion gas pressure.

Figure 6:
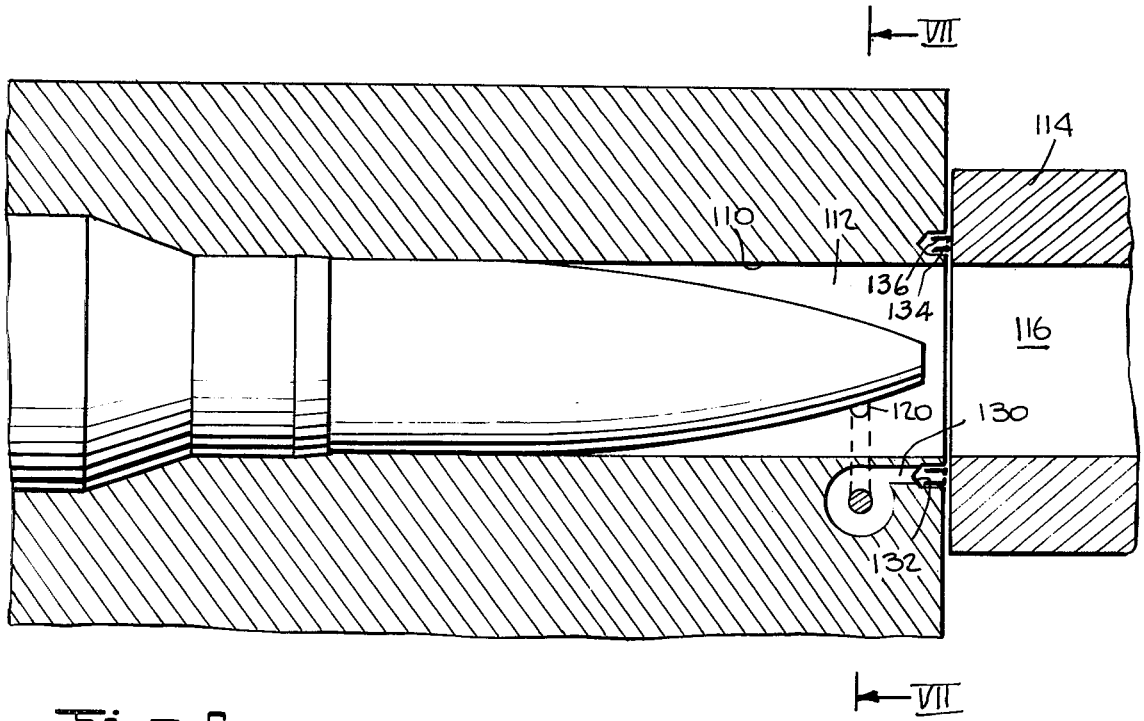
FIG. 6 is a longitudinal cross-section of portions of a firing chamber and a gun barrel incorporating the mechanism of FIG. 5.
Figure 7:
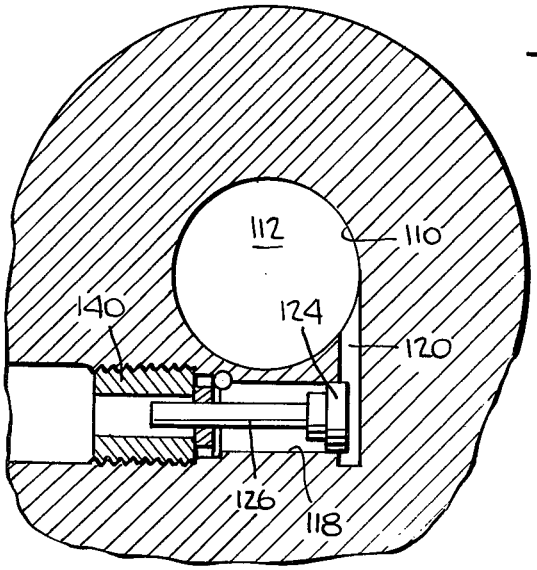
FIG. 7 is a transverse cross-section of the mechanism of FIG. 5 taken along the plane VII—VII.

As shown in FIGS. 6 and 7, the piston and the investment liquid may be retained in the cylinder by means of a plug 140. Suitable means for automatically charging the cylinder with a supply of grease between bursts of firing may be provided by an auxiliary pumping system, not shown.

The flow control rings are forced into the leakage interface 104. The rate of flow permitted by the rings is determined by surface conditions. Flow towards the atmosphere should be held to a minimum, while flow towards the chamber/bore should be more generous to fill the interface joint to preclude combustion gas from entering. Investment liquid, such as Molybdenum disulphide, should be selected to meet the high temperature and high pressure conditions provided by the combustion gas.

Figure 8:
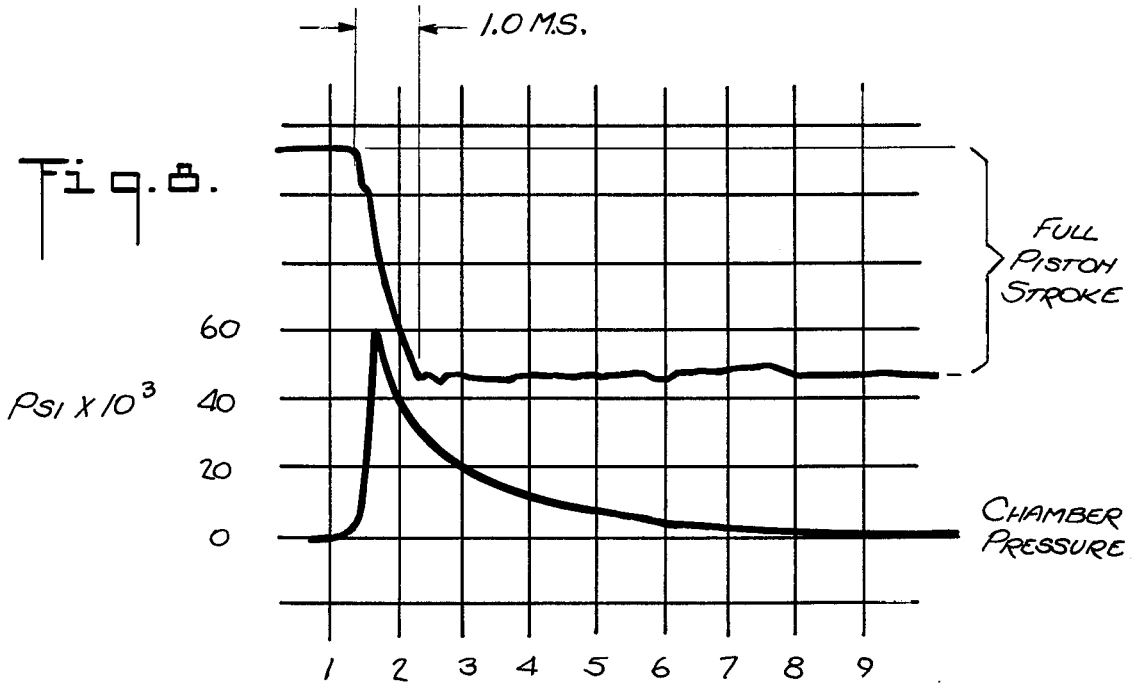
FIG. 8 is a chart showing chamber pressure and seal-piston stroke against time using "decalin" as an investment material; and, FIG. 9 is a chart showing chamber pressure and seal-piston stroke against time using grease as an investment material.

FIG. 8 shows piston stroke and chamber pressure versus time in a mechanism shown in FIG. 1 utilizing decalin as the investment liquid.

Figure 9:
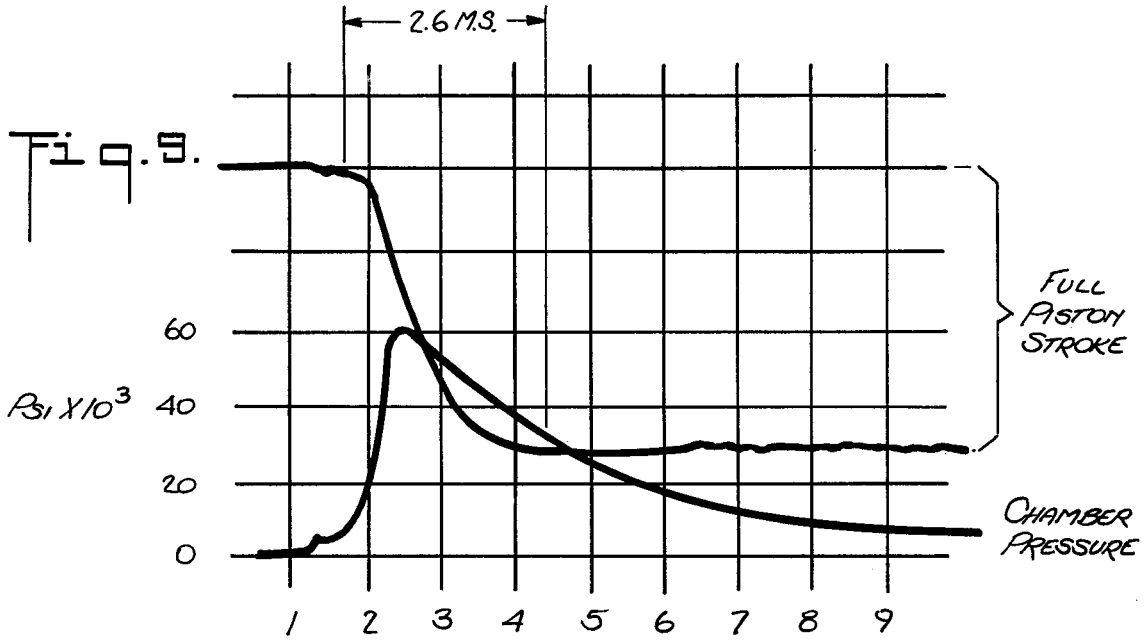

FIG. 9 is similar to FIG. 8, but utilizing a MIL-G-3278A grease.

What is claimed:

1. An engine comprising:

a combustion chamber;

a first means cyclically reciprocatable between a first station for closing one end of said combustion chamber and a second station for opening said one end of said combustion chamber;

said first means, when closing said combustion chamber, having a common interface therewith;

second means for providing combustion gas at a variable first pressure in said chamber;

third means for providing a liquid into said common interface at a variable second pressure which is always greater than said first pressure, whereby such liquid seals said common interface and a portion thereof flows into said combustion chamber.

2. An engine according to claim 1, wherein:
said third means includes
a pump having
a supply of such liquid having an outlet communicating with said common interface, and
a piston having a first face of a first cross-sectional area communicating with said combustion chamber, and a second face of a second cross-sectional area, which is smaller than said first area, communicating with said supply of such liquid.

3. An engine according to claim 1 wherein:
said engine is a gun;
said combustion chamber is part of a gun bore; and
said first means is a breech block.

4. An engine according to claim 1 wherein:
said engine is a gun;
said combustion chamber is part of a gun bore; and
said first means is a gun bolt.

5. An engine comprising:
a combustion chamber having an outlet port;
a conduit for juxtaposition with said outlet port;
said conduit, when juxtaposed with said outlet port, having a common interface therewith;
first means for providing combustion gas at a variable first pressure in said chamber;
second means for providing a liquid into said common interface at a variable second pressure which is always greater than said first pressure, whereby said liquid seals said common interface and a portion thereof flows into said combustion chamber.

6. An engine according to claim 5, wherein:
said second means includes
a pump having
a supply of such liquid having an outlet communicating
ith said common interface, and
a piston having a first face of a first cross-sectional area communicating with said combustion chamber, and a second face of a second cross-sectional area, which is smaller than said first area, communicating with said supply of such liquid.

7. An engine according to claim 5 wherein:
said engine is a gun;
said combustion chamber is part of a revolver; and
said conduit is a gun bore.

8. A gun comprising:
a gun barrel having a combustion chamber;
a gun bolt for closing one end of said chamber;
said bolt including:
a bolt body having a longitudinal bore therein,
a piston having a head disposed forward of said body and a stem journaled for reciprocation in said bolt body bore,
said piston head having a forward face of a first cross-sectional area proximal to and in communication with said chamber, and an aft face of a second cross-sectional area, which is less than said first cross-sectional area, and which is spaced from said bolt body to mutually define a void;
means for trapping liquid in said void; and
having a mode of operation such that force applied to said piston head forward face at a first pressure is communicated to liquid in said void by said piston head aft face at a second pressure which is greater than said first pressure.

9. A gun according to claim 8 wherein:
said gun bolt is adapted to be locked to said gun barrel, in which disposition said piston head and the forward portion of said bolt body enter the aft portion of said chamber, said piston head defining a first transverse clearance gap with respect to the adjacent wall of said chamber and said bolt body forward portion defining a second transverse clearance gap with respect to said adjacent wall of said chamber which is less than said first gap.

10. A gun according to claim 8 further including:
spring means coupled to and between said bolt body and said piston to urge an increase in the longitudinal size of said void, and wherein
force applied to said piston head forward face urges a decrease in the longitudinal size of said void.

11. A gun for firing liquid propellant comprising:
a gun barrel having a bore, a combustion chamber and an antechamber in serial, longitudinal alignment,
an inlet port opening into said antechamber,
a bolt journaled for longitudinal reciprocation and having at least two longitudinal dispositions,
a first disposition, whereat said bolt is aft of said inlet port, and permits liquid flow from said inlet port to said combustion chamber, and
a second disposition, forward of said first disposition, whereat said bolt obturates said combustion chamber and precludes liquid flow between said inlet port and said combustion chamber;
said bolt including:
a bolt body having a longitudinal bore therein,
a piston having a head disposed forward of said body and a stem journaled for limited reciprocation in said bolt body bore,
said piston head having a forward face of a first cross-sectional area, and an aft face of a second cross-sectional area, which is less than said first cross-sectional area,
means urging said piston forward of said bolt body, whereat said aft face of said piston head is spaced forward of said bolt body to mutually define a void;
said void adapted to receive liquid from said inlet port when said bolt is in its first disposition, and to trap liquid, in conjunction with the wall of said combustion chamber, when said bolt is in its second disposition;
said bolt having a mode of operation such that force applied to said piston head forward face by combustion gas at a first pressure in said combustion chamber is communicated to liquid trapped in said void by said piston head aft face at a second pressure which is greater than said first pressure.

12. A gun according to claim 11 further including:
a sleeve journaled for reciprocation on said bolt body and having a first disposition for permitting the flow of liquid from said inlet port towards said combustion chamber, and a second disposition for precluding the flow of liquid from said inlet port towards said combustion chamber;
spring means urging said sleeve to said second disposition; and
having a mode of operation such that the flow of liquid under pressure from said inlet port serves to displace said sleeve to said first disposition.

13. A gun according to claim 11 wherein:

said bolt body has a forward transverse face adapted to nest with said piston head aft face.

14. A gun according to claim 13 wherein: said bolt body forward portion has a diameter which is greater than the diameter of said piston head.

15. A gun according to claim 14 wherein said diameter of said bolt body forward portion is provided by an L-ring seal which communicates with said void.

* * * * *

UNITED STATES PATENT OFFICE

CERTIFICATE OF CORRECTION

Patent No. 4,050,352 Dated Sept. 27, 1977

Inventor(s) Douglas Pray Tassie

It is certified that error appears in the above-identified patent and that said Letters Patent are hereby corrected as shown below:

Column 1, line 28 change "the" to --this--.
Column 2, line 46 change "cahmber" to --chamber--.
Column 5, line 40 change "ith" to --with--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*